United States Patent [19]

Nohira et al.

[11] 4,056,933

[45] Nov. 8, 1977

[54] EXHAUST GAS PURIFIER IN AN INTERNAL COMBUSTION ENGINE

[75] Inventors: Hidetaka Nohira; Kiyoshi Kobashi, both of Susono, Japan

[73] Assignee: Toyota Jidosha Kogyo Kabushiki Kaisha, Japan

[21] Appl. No.: 687,757

[22] Filed: May 19, 1976

[30] Foreign Application Priority Data

Jan. 9, 1976 Japan ..... 51-1473

[51] Int. Cl.[2] ..... F02M 25/06; F01N 3/10

[52] U.S. Cl. ..... 60/278; 60/305; 60/313

[58] Field of Search ..... 60/278, 282, 323, 305, 60/313

[56] References Cited

U.S. PATENT DOCUMENTS

| | | | |
|---|---|---|---|
| 1,294,475 | 2/1919 | Kirkham | 60/323 |
| 2,188,444 | 1/1940 | Sauer | 60/323 |
| 3,500,807 | 3/1970 | Daigh | 60/278 |
| 3,776,207 | 12/1973 | Simko | 60/278 |
| 3,938,330 | 2/1976 | Nakajima | 60/323 |
| 3,982,395 | 9/1976 | Hasegawa | 60/278 |

*Primary Examiner*—Douglas Hart

*Attorney, Agent, or Firm*—Stevens, Davis, Miller & Mosher

[57] ABSTRACT

An exhaust gas purifier in an internal combustion engine having a plurality of cylinders and two separate exhaust manifolds. Two separate exhaust pipes are connected to the corresponding exhaust manifolds, one of the exhaust pipes being joined with the other exhaust pipe. The recirculated exhaust gas is extracted from the one exhaust pipe and is delivered into the air intake system. Secondary air is fed into the other exhaust manifold.

6 Claims, 4 Drawing Figures

EXHAUST GAS PURIFIER IN AN INTERNAL COMBUSTION ENGINE

DESCRIPTION OF THE INVENTION

The present invention relates to an exhaust gas purifier in an internal combustion engine. An internal combustion engine has been proposed, which is provided with an exhaust gas purifier in which, in order to reduce harmful components in the exhaust gas, for example, unburned hydrocarbons and carbon monoxide, secondary air is fed into the exhaust system. The exhaust system comprises the exhaust manifold and the exhaust pipe connected to the outlet side of the exhaust manifold, and the secondary air is fed from a secondary air feed pump driven by the engine. The object is to burn unburned components in the exhaust gas. To reduce harmful components in the exhaust gas, for example oxides of nitrogen, some part of the exhaust gas extracted from the exhaust system is recirculated into the air intake system, for example, into the intake manifold. In such an internal combustion engine in order to effectively reduce the amount of oxides of nitrogen in the exhaust gas, it is desirable that the exhaust gas recirculated to the air intake system contains as little oxygen as possible, i.e. exhaust gas containing no air. This will be more apparent from FIG. 1. In FIG. 1, the ordinate indicates an amount of nitrogen oxides ($NO_x$) in the exhaust gas and the abscissa indicates the air-fuel ratio A/F of the fuel mixture fed into the engine cylinders. Furthermore, curve A shows the amount of $NO_x$ in the exhaust gas when the exhaust gas is not recirculated, and curve B shows the amount of $NO_x$ in the exhaust gas when the exhaust gas in recirculated to the intake system, for example, with exhaust gas contains no secondary air at the rate of 10 weight percent relative to the weight of the fuel mixture. Consequently, assuming that the fuel mixture in the intake manifold has the air-fuel ratio A/F indicated by the point C, the amount of $NO_x$ in the exhaust gas is indicated by the point D when exhaust gas is not recirculated, and the amount of $NO_x$ in the exhaust gas is indicated by the point E when the exhaust gas is recirculated. Consequently, it is understood that the amount of $NO_x$ in the exhaust gas is considerably reduced when effecting exhaust gas recirculation. However, if the exhaust gas containing secondary air is fed into, for example, the fuel mixture in the intake manifold, the air-fuel ratio of the fuel mixture fed into the engine cylinders increases and a smaller amount of exhaust gas is fed into the fuel mixture in the intake manifold than in case where the exhaust gas contains no air. In this situation the amount of $NO_x$ in the exhaust gas is indicated by the point F. Therefore, the amount of $NO_x$ in the exhaust gas increases by $\Delta$ G as compared with the case where the exhaust gas contains no secondary air.

Consequently, in order to effectively reduce the amount of $NO_x$ in the exhaust gas, it is necessary to prevent secondary air from mixing with the exhaust gas to be recirculated, and this presents a problem, particularly when secondary air is fed into the exhaust system for burning unburned components in the exhaust gas. In order to resolve the problem, an internal combustion engine has been proposed, in which the injecting operation of one of the secondary air injection nozzles, each nozzle being disposed in the respective exhaust port connecting the corresponding cylinder with a branch of the exhaust manifold, is stopped, and part of the exhaust gas is extracted from the exhaust port or the branch of the exhaust manifold having the injection nozzle, the injecting operation of which is stopped, and secondary air is injected into the remaining exhaust ports. Furthermore, in order to more effectively prevent secondary air from mixing with the exhaust gas to be recirculated, an exhaust manifold has been proposed in which the branch of the exhaust manifold for extracting a part of the exhaust gas is joined near to the outlet of the exhaust manifold with the remaining branches of the exhaust manifold into which secondary air is fed. However, because the exhaust gas pressure pulsates, if the above-mentioned exhaust manifold were adopted for the exhaust system of the engine, the exhaust gas containing secondary air therein would, to a large extent, flow in the reverse direction into the branch of the exhaust manifold used for extracting part of the exhaust gas from the remaining branches of the exhaust manifold. Consequently, a large amount of secondary air is mixed with the exhaust gas to be recirculated. Thus it is impossible to completely remove secondary air from the exhaust gas to be recirculated.

An object of the present invention is to provide an exhaust gas purifier in an internal combustion engine which can completely prevent secondary air from mixing with the exhaust gas to be recirculated.

According to the present invention, an exhaust gas purifier in an internal combustion engine having a plurality of cylinders and an air intake system, comprises a first exhaust manifold connected to at least one cylinder, a second exhaust manifold connected to the remaining cylinders, a first exhaust pipe connected to an exhaust gas outlet of said first exhaust manifold, a second exhaust pipe connected to an exhaust gas outlet of said second exhaust manifold, an exhaust gas outlet of said second exhaust pipe being connected with said first exhaust pipe, a recirculated exhaust gas inlet disposed in an exhaust gas passage formed between said one cylinder and the exhaust gas outlet of said first exhaust manifold; a recirculated exhaust gas outlet disposed in the air intake system, a recirculated exhaust gas conduit connecting said recirculated exhaust gas inlet with said recirculated exhaust gas outlet for delivering recirculated exhaust gas from said recirculated exhaust gas inlet to the recirculated exhaust gas outlet, means for controlling the flow rate of the recirculated exhaust gas in the recirculated exhaust gas conduit, and means for feeding secondary air into an exhaust gas passage formed between said remaining cylinders and the exhaust gas outlet of said second exhaust manifold.

The above-mentioned object of the present invention may be more fully understood from the following description of preferred embodiments of the invention, together with the accompanying drawings.

DESCRIPTION OF PREFERRED EMBODIMENTS

Figure 1:
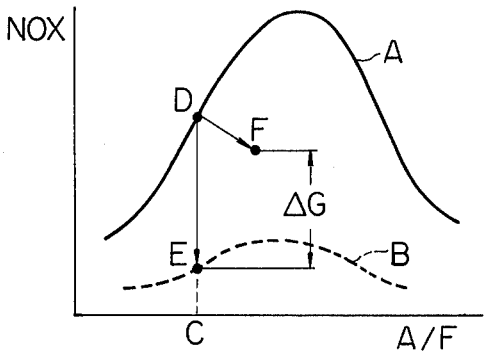
FIG. 1 is a graph showing the relationship between the air-fuel ratio A/F and an amount of $NO_x$ in the exhaust gas.
Figure 2:
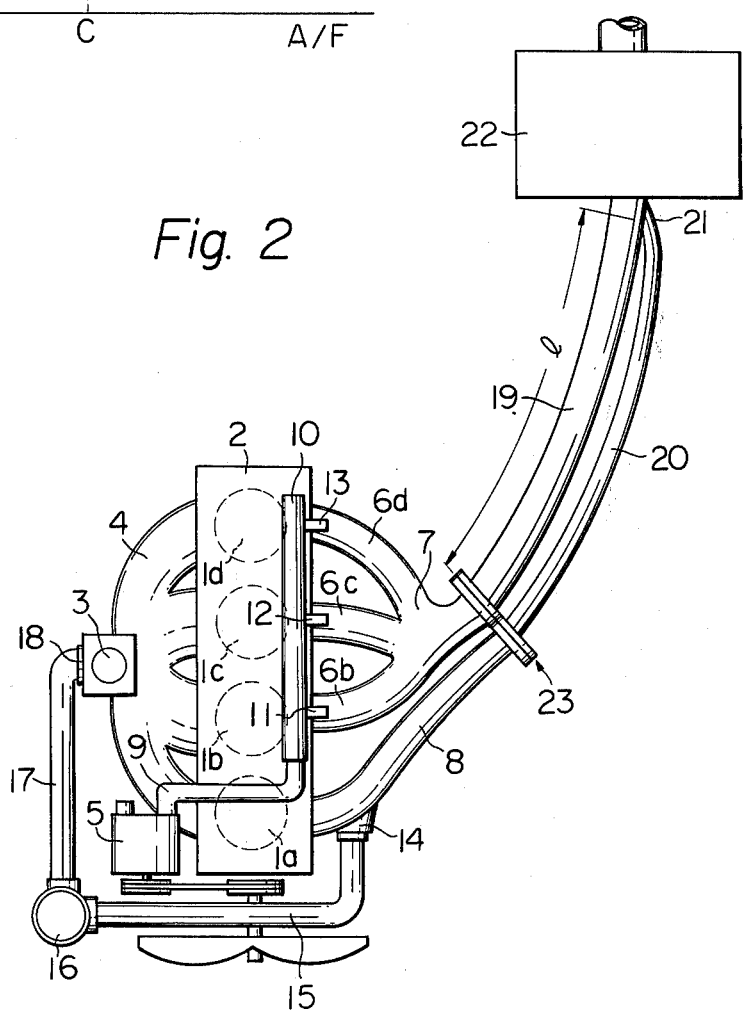
FIG. 2 is a schematic plan view of an internal combustion engine having an exhaust gas purifier according to the present invention.

FIG. 2 shows an embodiment in the case of applying the present invention to a four-cylinder engine. Referring to FIG. 2, the engine body 2, having four cylinders 1*a*, 1*b*, 1*c* and 1*d*, is provided with an intake manifold 4 having a carbureter 3 and an air pump 5 driven by the engine. Furthermore, the engine body 2 is provided with a first exhaust manifold 7 comprising the branches 6*b*, 6*c* and 6*d* corresponding to the cylinders 1*b*, 1*c* and 1*d*, respectively, and a second exhaust manifold 8 corresponding to the cylinder 1*a*. Secondary air is delivered into an air manifold 10 from the air pump 5 via a secondary air conduit 9, and then is fed via the secondary air injection nozzles 11, 12 and 13 into the corresponding branches 6*b*, 6*c* and 6*d* of the exhaust manifold 7 from the air manifold 10. Recirculated exhaust gas is delivered, via a recirculated exhaust gas conduit 15, a flow rate control valve 16, a recirculated exhaust gas conduit 17 and a recirculated exhaust gas outlet 18, connected upstream of the throttle valve of the carbureter 3. To the intake manifold 4, from a recirculated exhaust gas inlet 14 mounted on the exhaust manifold 8. Of course the recirculated exhaust gas outlet 18 may be mounted on the intake manifold 4. The flow rate control valve 16 is provided for controlling the flow rate of the recirculated exhaust gas. For example, exhaust gas can be recirculated in an amount proportional to that of the inducted air by means of the flow rate control valve 16. Separate exhaust pipes 19 and 20 are connected to the exhaust manifold 7 and 8, respectively, and the exhaust pipe 19 is joined to the exhaust pipe 20 at the position indicated by 21. The exhaust pipe 19 is connected to the muffler 22 downstream of the junction 21. However, as will be hereinafter described, the muffler 22 may be replaced by a catalytic converter.

Secondary air fed from the secondary air injection nozzles is mixed with the exhaust gas from the cylinders 1*b*, 1*c* and 1*d*, and thus exhaust gas containing air is delivered into the muffler or the catalytic converter 22 via the exhaust manifold 7 and the exhaust pipe 19. On the other hand, part of the exhaust gas from the cylinder 1*a* is recirculated into the intake manifold 4 via the recirculated exhaust gas inlet 14, and the remaining exhaust gas flows in the exhaust manifold 8 and the exhaust pipe 20 and then is mixed with the exhaust gas flowing in the exhaust pipe 19 at the junction 21.

As is apparent from FIG. 2, the junction 21 of the exhaust pipes 19 and 20 is considerably removed from the exhaust ports of the cylinders. Consequently, the exhaust gas near to the junction 21 is scarcely influenced by the pressure pulsation of the exhaust gas, thus avoiding reverse flow of the exhaust gas containing air in the exhaust pipe 19 into the exhaust manifold 8 via the junction 21 and the exhaust pipe 20. This results in preventing air from mixing with the recirculated exhaust gas fed into the exhaust manifold 4 from the recirculated exhaust gas inlet 14. It is preferable that the distance between the junction 21 and the connecting position 23 of the exhaust manifolds 7, 8 with the exhaust pipes 19, 20 is as long as possible. However, it has been proved that air is not mixed with the recirculated exhaust gas if the above-mentioned distance is more than 15 cm.

The oxidation of the exhaust gas flowing in the exhaust manifold 7 is promoted by means of secondary air, and unburned hydrocarbons and carbon monoxide in the exhaust gas are gradually removed as the exhaust gas flows in the exhaust pipe 19. Then, the exhaust gas flowing in the exhaust pipe 19, together with the exhaust gas flowing in the exhaust pipe 20, are delivered to the muffler 22, and therein the oxidation of the exhaust gas is further promoted. However, if unburned hydrocarbons and carbon monoxides are not sufficiently removed in the muffler 22, it is preferable to provide a catalytic converter 22 instead of the muffler 22.

Figure 3:
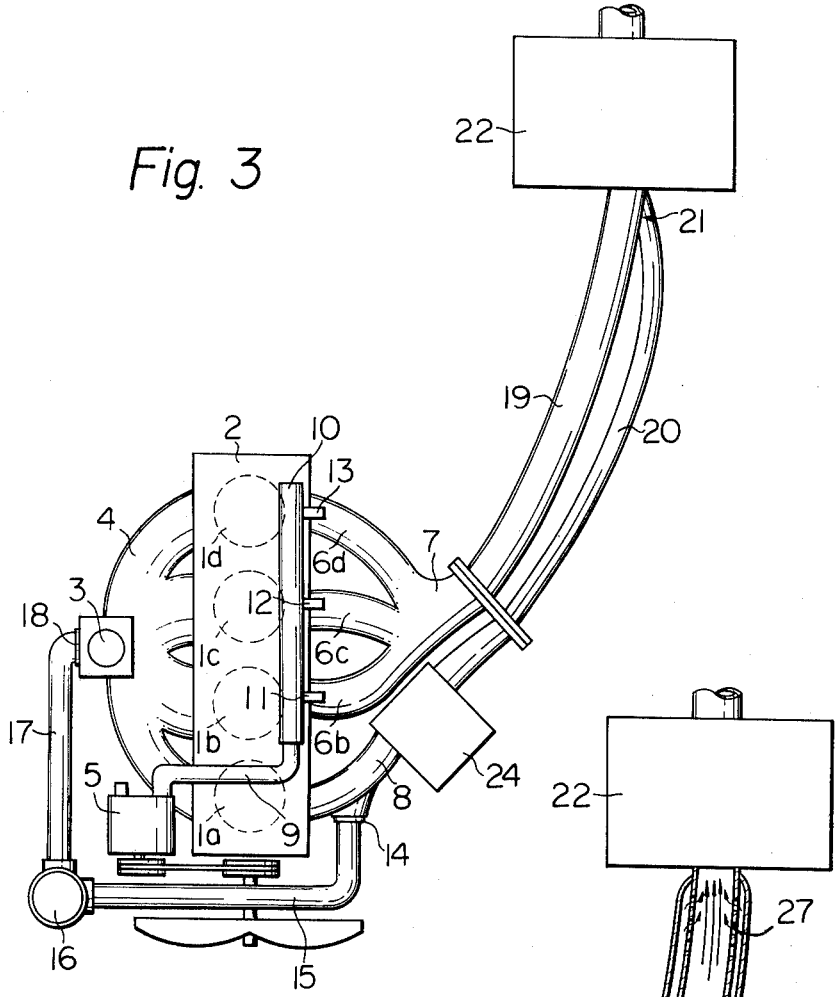
FIG. 3 is a plan view of an alternative embodiment according to the present invention.
Figure 4:
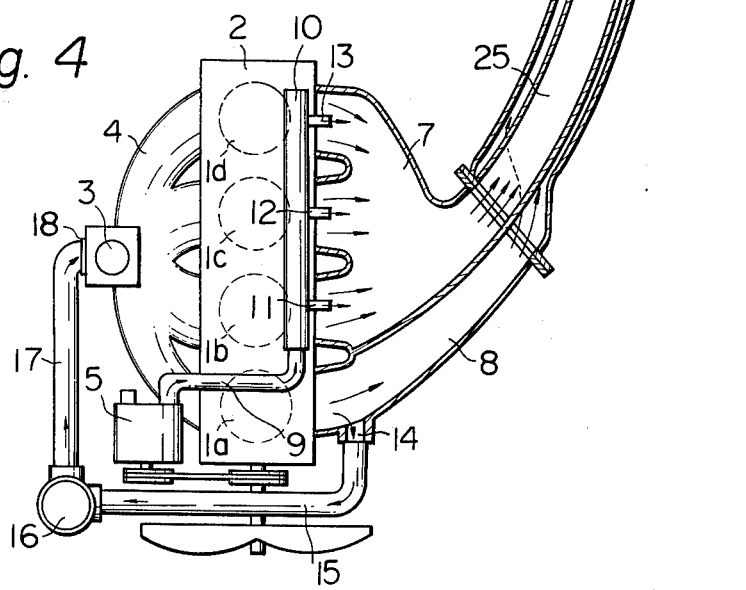
FIG. 4 is a plan view of a further embodiment according to the present invention.

FIGS. 3 and 4 show an alternative embodiment of an exhaust gas purifier according to the present invention. In FIG. 3, similar components are indicated with the same reference numerals in FIG. 2. The difference in construction between FIG. 2 and FIG. 3 resides in providing a surge tank 24 in the exhaust manifold 8 for supressing to some extent the pressure pulsation of the exhaust gas. This results in minimizing the degree of pressure pulsation in the exhaust pipe 20, thereby completely preventing the reverse flow of the exhaust gas containing air in the exhaust pipe 19 into the exhaust pipe 20 via the junction 21.

Referring to FIG. 4, the difference in construction between FIG. 2 and FIG. 4 resides in that in the latter case the exhaust manifold 7 and the exhaust manifold 8 are formed in one piece, and the exhaust pipe 25 and the exhaust pipe 26 are formed as a concentric double pipe construction so that the exhaust pipe 25 from the manifold 7 is surrounded by the exhaust pipe 26 from the manifold 8. The exhaust gas from the cylinder 1*a* flows along the exhaust pipe 26 around the exhaust pipe 25, and then is mixed with the exhaust gas delivered from the cylinders 1*b*, 1*c* and 1*d* via openings 27. Such a double pipe construction enables the heat in the exhaust gas containing an air in the exhaust pipe 25 to be retained by the heat of the exhaust gas flowing in the exhaust pipe 26. This results in promoting the oxidation of unburned hydrocarbons and carbon monoxides in the exhaust gas flowing in the exhaust pipe 25.

In the embodiments shown in FIGS. 2 to 4, the exhaust manifold system comprises the exhaust manifold 8 receiving the exhaust gas from the single cylinder 1*a* and the exhaust manifold 7 receiving the exhaust gas from the three cylinders 1*b*, 1*c* and 1*d*. However, the exhaust manifold system may comprise an exhaust manifold receiving the exhaust gas from two cylinders, for example, 1*a* and 1*b*, and an exhaust manifold receiving the exhaust gas from the remaining cylinders 1*c* and 1*d*, secondary air being fed into one of the above two exhaust manifolds, and recirculated exhaust gas being extracted from the other exhaust manifold.

According to the present invention, it is possible to greatly reduce the amount of $NO_x$ in the exhaust gas, since air can be completely prevented from mixing with the recirculated exhaust gas. Furthermore in an internal combustion engine according to the present invention, the amount of unburned hydrocarbons and carbon monoxide in the exhaust gas is reduced at the same time. However, the efficiency of reduction of unburned hydrocarbons and carbon monoxides is greatly improved by providing a catalytic converter instead of the muffler 22.

What is claimed is:

1. An exhaust gas purifier in an internal combustion engine having a plurality of cylinders and an air intake system, comprising:

a first exhaust manifold connected to at least one of said cylinders, said first exhaust manifold having an exhaust gas outlet;

a second exhaust manifold connected to the remaining cylinders other than said at least one cylinder, said second exhaust manifold having an exhaust gas outlet;

a first exhaust pipe fluidly connected to the exhaust gas outlet of said first exhaust manifold, said first exhaust pipe having an exhaust gas outlet;

a second exhaust pipe fluidly connected to the exhaust gas outlet of said second exhaust manifold, the exhaust gas outlet of said first exhaust pipe being fluidly connected with said second exhaust pipe at a position remote from the exhaust gas outlet of said second exhaust manifold so that the exhaust gas in said second exhaust manifold does not enter into said first exhaust manifold;

an exhaust gas passage between said remaining cylinders and the exhaust gas outlet of said second exhaust manifold;

means for feeding secondary air into the exhaust gas passage between said remaining cylinders and the exhaust gas outlet of said second exhaust manifold;

an exhaust gas passage between said one cylinder and the exhaust gas outlet of said first exhaust manifold;

a recirculated exhaust gas inlet disposed in the exhaust gas passage between said one cylinder and the exhaust gas outlet of said first exhaust manifold;

a recirculated exhaust gas outlet disposed in the air intake system;

a recirculated exhaust gas conduit fluidly connecting said recirculated exhaust gas inlet with said recirculated exhaust gas outlet for delivering recirculated exhaust gas containing no secondary air therein from said recirculated exhaust gas inlet to the recirculated exhaust gas outlet; and means for controlling the flow rate of the recirculated exhaust gas in the recirculated exhaust gas conduit.

2. An exhaust gas purifier as recited in claim 1, wherein the distance between the connection of said first exhaust pipe with said second exhaust pipe and the connecting position of said exhaust manifolds with said exhaust pipes is more than 15 cm.

3. An exhaust gas purifier as recited in claim 1, wherein said first exhaust manifold and said second exhaust manifold are formed in one piece.

4. An exhaust gas purifier as recited in claim 1, further comprising a surge tank in said first exhaust manifold, and said recirculated exhaust gas inlet is in said first exhaust manifold upstream of the surge tank.

5. An exhaust gas purifier as recited in claim 1, further comprising a catalytic converter in said second exhaust pipe, and said first exhaust pipe is connected with said second exhaust pipe upstream of said catalytic converter.

6. An exhaust gas purifier as recited in claim 5, wherein said first exhaust pipe and said second exhaust pipe are concentrically arranged so that the two exhaust pipes are in heat-exchange relationship.

* * * * *